US010717576B2

(12) United States Patent
Jeppesen

(10) Patent No.: US 10,717,576 B2
(45) Date of Patent: Jul. 21, 2020

(54) CONTAINER FOR POLYPEPTIDE

(71) Applicant: Novozymes A/S, Bagsvaerd (DK)

(72) Inventor: Thomas Jeppesen, Taastrup (DK)

(73) Assignee: Novozymes A/S, Bagsvaerd (DK)

( * ) Notice: Subject to any disclaimer, the term of this patent is extended or adjusted under 35 U.S.C. 154(b) by 74 days.

(21) Appl. No.: 15/574,541

(22) PCT Filed: Jun. 14, 2016

(86) PCT No.: PCT/EP2016/063605
§ 371 (c)(1),
(2) Date: Nov. 16, 2017

(87) PCT Pub. No.: WO2016/202785
PCT Pub. Date: Dec. 22, 2016

(65) Prior Publication Data

US 2018/0127182 A1 May 10, 2018

(30) Foreign Application Priority Data

Jun. 17, 2015 (EP) ..... 15172533
Sep. 8, 2015 (EP) ..... 15184349

(51) Int. Cl.

| | |
|---|---|
| ***B65D 25/14*** | (2006.01) |
| ***B65D 75/00*** | (2006.01) |
| ***B65D 75/56*** | (2006.01) |
| ***B65D 75/58*** | (2006.01) |
| ***B65D 5/56*** | (2006.01) |
| ***B65D 23/02*** | (2006.01) |

(52) U.S. Cl.
CPC ..... *B65D 75/008* (2013.01); *B65D 5/56* (2013.01); *B65D 23/02* (2013.01); *B65D 25/14* (2013.01); *B65D 75/56* (2013.01); *B65D 75/5866* (2013.01); *B65D 2213/02* (2013.01); *B65D 2590/023* (2013.01)

(58) Field of Classification Search
CPC .. B65D 75/008; B65D 75/5866; B65D 75/56; B65D 23/02; B65D 25/14; B65D 5/56; B65D 2590/023; B65D 2213/02
See application file for complete search history.

(56) References Cited

U.S. PATENT DOCUMENTS 4,756,414 A 7/1988 Mott et al.
6,585,843 B2 * 7/2003 Nickell ..... A43B 1/0045 156/148

(Continued)

FOREIGN PATENT DOCUMENTS

CN 101433345 A 5/2009
CN 203126061 8/2013

(Continued)

*Primary Examiner* — Nicolas A Arnett
(74) *Attorney, Agent, or Firm* — Eric Fechter

(57) ABSTRACT

A closable and sealable, preferably thermoplastic plastic container (1) for storing, transporting and dispensing a powdery or granular polypeptide, said container comprising a circumferential wall (2) having an upper end and a lower end and at the lower end joining a closed bottom wall (7) and being at the upper end provided with a closable outlet member (16) having an outlet opening, the container having an inner surface and an outer surface, the inner surface being an antistatic surface adapted to be in contact with the polypeptide.

15 Claims, 10 Drawing Sheets

(56) References Cited

U.S. PATENT DOCUMENTS

| | | | | |
|---|---|---|---|---|
| 6,592,702 | B2 * | 7/2003 | Nickell | A43B 1/0045 156/244.11 |
| 9,558,862 | B2 * | 1/2017 | Sawai | C08K 5/20 |
| 2007/0181857 | A1 * | 8/2007 | Nishioka | C08L 65/00 252/500 |
| 2008/0085065 | A1 | 4/2008 | Nowak et al. | |
| 2008/0113135 | A1 * | 5/2008 | Kato | B32B 27/08 428/35.8 |
| 2011/0152820 | A1 * | 6/2011 | Chattaraj | A61M 5/14546 604/403 |
| 2013/0139475 | A1 | 6/2013 | Ying et al. | |
| 2014/0315187 | A1 * | 10/2014 | Guo | B65D 79/02 435/5 |
| 2015/0122840 | A1 | 5/2015 | Cox et al. | |
| 2015/0216795 | A1 * | 8/2015 | Assadourian | A61K 38/1866 424/134.1 |
| 2017/0175263 | A1 * | 6/2017 | Yamamoto | B65D 23/0821 |

FOREIGN PATENT DOCUMENTS

| | | | | |
|---|---|---|---|---|
| CN | 203173045 | | 9/2013 | |
| CN | 104366475 | A | 2/2015 | |
| EP | 1808377 | A1 | 7/2007 | |
| GB | 2219270 | A * | 12/1989 | B65D 25/385 |
| JP | 3544419 | | 7/2004 | |
| WO | 1996001105 | A1 | 1/1996 | |
| WO | 2000/058166 | A1 | 10/2000 | |
| WO | 2013/033600 | A1 | 3/2013 | |
| WO | 2014/020160 | A1 | 2/2014 | |

* cited by examiner

CONTAINER FOR POLYPEPTIDE

CROSS-REFERENCE TO RELATED APPLICATIONS

This application is a 35 U.S.C. 371 national application of PCT/EP2016/063605, filed Jun. 14, 2016 and published as WO2016/202785 on Dec. 22, 2016, which claims priority or the benefit under 35 U.S.C. 119 of European application no. 15172533.0 filed Jun. 17, 2015 and European application no. 15184349.7 filed Sep. 8, 2015, the contents of which are fully incorporated herein by reference.

FIELD OF THE INVENTION

The present invention relates to a container for storing, transporting and dispensing a granular or powdery polypeptide, such as enzymes. Today, dispensing enzymes from a container into a vessel is typically carried out in a completely closed compartment and by people wearing protective suits. Such an approach is extremely expensive and is particularly not suitable on emerging markets.

BACKGROUND OF THE INVENTION

Storing, transporting and especially adding enzymes to detergent formulations in production factories can be challenging, especially in emerging markets, as these factories are typically not designed to handle enzymes causing health risk.

US 2015/122840 A1 discloses a flexible container and it is mentioned that films can comprise an anti-static agent.

WO 2013/033600 A1 discloses a container in which a material such as a polypeptide may be disposed.

U.S. Pat. No. 4,756,414 A1 discloses a flexible sheet material for forming a bag for containing electrostatically sensitive components. The sheet material includes a first flexible heat sealable plastic material with antistatic properties on at least the one major surface thereof, which first layer is laminated to a second flexible plastic material with an electrically conductive material on the one major surface thereof and antistatic properties on the other major surface thereof.

US 2013/139475 A1 discloses a packing bag of a liquid crystal display having a sealing structure made of an antistatic material.

WO 2014/020160 A1 discloses an article of manufacture comprising: a packing material, a polypeptide SEQ ID NO:1, and a label comprising a printed statement which informs a prospective user of adverse events or adverse reactions.

EP 1 808 377 A1 discloses a bag comprising a laminated film of a polystyrene film and a polyethylene film, and where the polyethylene film may contain an antistatic agent.

SUMMARY OF THE INVENTION

The object of the present invention is to provide a container that allows for a leak proof connection to a vessel to which the content of the container is to be dispensed so that a closed system is provided between the container and the vessel and thereby allows the content of the container to be dispensed into the vessel in a safe manner without exposing the environment to the health risk of enzyme exposure. Further, the container should allow for an essentially complete emptying of the container during dispensing of the content so that essentially no peptides remain in the container.

The above objects are according to a first aspect of the present invention obtained by a providing a closable and sealable, preferably thermoplastic plastic container for storing, transporting and dispensing a powdery or granular polypeptide, said container comprising a circumferential wall having an upper end and a lower end and at the lower end joining a closed bottom wall and being at the upper end provided with a closable outlet member having an outlet opening, the container having an inner surface and an outer surface, the inner surface being an antistatic surface adapted to be in contact with the polypeptide.

According to a second aspect of the present invention, the above objects are obtained by a closed and sealed, preferably thermoplastic, plastic container in which a powdery or granular polypeptide is stored, said container comprising a circumferential wall having an upper end and a lower end and at the lower end joining a closed bottom wall and being at the upper end provided with a closed outlet member having an outlet opening, the container having an inner surface and an outer surface, the inner surface being an antistatic surface adapted to be in contact with the polypeptide.

The antistatic inner surface of the container provides for a fast and reliable filling of the container and more importantly also provides for a fast and essentially complete emptying of the container so that essentially no powdery polypeptides remain in the container. As a result, the empty container can be handled in a safe manner without essentially exposing the environment to the health risk of enzyme exposure.

By the term polypeptide is to be understood a chain of amino acids linked by peptide bonds. The polypeptides can catalyse a specific reaction such as enzymes having a specific action on a substrate.

Enzymes

The container of the invention may contain one or more enzymes such as a protease, lipase, cutinase, an amylase, carbohydrase, cellulase, pectinase, mannanase, arabinase, galactanase, xylanase, oxidase, e.g., a laccase, and/or peroxidase. The enzymes can be present in the container as granules or powder comprising a single enzyme or a blend of enzymes.

Cellulases

Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g. the fungal cellulases produced from *Humicola insolens, Myceliophthora thermophila* and *Fusarium oxysporum* disclosed in U.S. Pat. Nos. 4,435,307, 5,648,263, 5,691,178, 5,776,757 and WO 89/09259.

Especially suitable cellulases are the alkaline or neutral cellulases having colour care benefits. Examples of such cellulases are cellulases described in EP 0 495 257, EP 0 531 372, WO 96/11262, WO 96/29397, WO 98/08940. Other examples are cellulase variants such as those described in WO 94/07998, EP 0 531 315, U.S. Pat. Nos. 5,457,046, 5,686,593, 5,763,254, WO 95/24471, WO 98/12307 and WO99/001544.

Other cellulases are endo-beta-1,4-glucanase enzymes having a sequence of at least 97% identity to the amino acid sequence of position 1 to position 773 of SEQ ID NO:2 of WO 2002/099091 or a family 44 xyloglucanase, which a xyloglucanase enzyme having a sequence of at least 60% identity to positions 40-559 of SEQ ID NO: 2 of WO 2001/062903.

Commercially available cellulases include Celluzyme™, and Carezyme™ (Novozymes A/S) Carezyme Premium™ (Novozymes A/S), Celluclean™ (Novozymes A/S), Celluclean Classic™ (Novozymes A/S), Cellusoft™ (Novozymes A/S), Whitezyme™ (Novozymes A/S), Clazinase™, and Puradax HA™ (Genencor International Inc.), and KAC-500(B)™ (Kao Corporation).

Mannanases

Suitable mannanases include those of bacterial or fungal origin. Chemically or genetically modified mutants are included. The mannanase may be an alkaline mannanase of Family 5 or 26. It may be a wild-type from *Bacillus* or *Humicola*, particularly *B. agaradhaerens, B. licheniformis, B. halodurans, B. clausii*, or *H. insolens*. Suitable mannanases are described in WO 1999/064619. A commercially available mannanase is Mannaway (Novozymes A/S).

Proteases

Suitable proteases include those of bacterial, fungal, plant, viral or animal origin, e.g. vegetable or microbial origin. Microbial origin is preferred. Chemically modified or protein engineered mutants are included. It may be an alkaline protease, such as a serine protease or a metalloprotease. A serine protease may for example be of the Si family, such as trypsin, or the S8 family such as subtilisin. A metalloproteases protease may for example be a thermolysin from e.g. family M4 or other metalloprotease such as those from M5, M7 or M8 families.

The term "subtilases" refers to a sub-group of serine protease according to Siezen et al., Protein Engng. 4 (1991) 719-737 and Siezen et al. Protein Science 6 (1997) 501-523. Serine proteases are a subgroup of proteases characterized by having a serine in the active site, which forms a covalent adduct with the substrate. The subtilases may be divided into 6 sub-divisions, i.e. the Subtilisin family, the Thermitase family, the Proteinase K family, the Lantibiotic peptidase family, the Kexin family and the Pyrolysin family.

Examples of subtilases are those derived from *Bacillus* such as *Bacillus lentus, B. alkalophilus, B. subtilis, B. amyloliquefaciens, Bacillus pumilus* and *Bacillus gibsonii* described in; U.S. Pat. No. 7,262,042 and WO09/021867, and subtilisin *lentus*, subtilisin Novo, subtilisin Carlsberg, *Bacillus licheniformis*, subtilisin BPN', subtilisin 309, subtilisin 147 and subtilisin 168 described in WO89/06279 and protease PD138 described in (WO93/18140). Other useful proteases may be those described in WO92/175177, WO01/016285, WO02/026024 and WO02/016547.

Examples of trypsin-like proteases are trypsin (e.g. of porcine or bovine origin) and the *Fusarium* protease described in WO89/06270, WO94/25583 and WO05/040372, and the chymotrypsin proteases derived from Cellumonas described in WO05/052161 and WO05/052146.

A further preferred protease is the alkaline protease from *Bacillus lentus* DSM 5483, as described for example in WO95/23221, and variants thereof which are described in WO92/21760, WO95/23221, EP1921147 and EP1921148.

Examples of metalloproteases are the neutral metalloprotease as described in WO07/044993 (Genencor Int.) such as those derived from *Bacillus amyloliquefaciens*.

Examples of useful proteases are the variants described in: WO92/19729, WO96/034946, WO98/20115, WO98/20116, WO99/011768, WO01/44452, WO03/006602, WO04/03186, WO04/041979, WO07/006305, WO11/036263, WO11/036264, especially the variants with substitutions in one or more of the following positions: 3, 4, 9, 15, 27, 36, 57, 68, 76, 87, 95, 96, 97, 98, 99, 100, 101, 102, 103, 104, 106, 118, 120, 123, 128, 129, 130, 160, 167, 170, 194, 195, 199, 205, 206, 217, 218, 222, 224, 232, 235, 236, 245, 248, 252 and 274 using the BPN' numbering. More preferred the subtilase variants may comprise the mutations: S3T, V4I, S9R, A15T, K27R, *36D, V68A, N76D, N87S,R, *97E, A98S, S99G,D,A, S99AD, S101G,M,R S103A, V104I,Y,N, S106A, G118V,R, H120D,N, N123S, S128L, P129Q, S130A, G160D, Y167A, R170S, A194P, G195E, V199M, V205I, L217D, N218D, M222S, A232V, K235L, Q236H, Q245R, N252K, T274A (using BPN' numbering).

Suitable commercially available protease enzymes include those sold under the trade names Alcalase®, Duralase™, Durazym™, Relase®, Relase® Ultra, Savinase®, Savinase® Ultra, Primase®, Polarzyme®, Kannase®, Liquanase®, Liquanase® Ultra, Ovozyme®, Coronase®, Coronase® Ultra, Blaze®, Neutrase®, Everlase® and Esperase® (Novozymes A/S), those sold under the tradename Maxatase®, Maxacal®, Maxapem®, Purafect®, Purafect Prime®, Purafect MAO, Purafect Ox®, Purafect OxP®, Puramax®, Properase®, FN2®, FN3®, FN4®, Excellase®, Eraser®, Opticlean® and Optimase® (Danisco/DuPont), Axapem™ (Gist-Brocases N.V.), BLAP (sequence shown in FIG. 29 of U.S. Pat. No. 5,352,604) and variants hereof (Henkel AG) and KAP (*Bacillus alkalophilus* subtilisin) from Kao.

Lipases and Cutinases

Suitable lipases and cutinases include those of bacterial or fungal origin. Chemically modified or protein engineered mutant enzymes are included. Examples include lipase from *Thermomyces*, e.g. from *T. lanuginosus* (previously named *Humicola lanuginosa*) as described in EP258068 and EP305216, cutinase from *Humicola*, e.g. *H. insolens* (WO96/13580), lipase from strains of *Pseudomonas* (some of these now renamed to *Burkholderia*), e.g. *P. alcaligenes* or *P. pseudoalcaligenes* (EP218272), *P. cepacia* (EP331376), P. sp. strain SD705 (WO95/06720 & WO96/27002), *P. wisconsinensis* (WO96/12012), GDSL-type *Streptomyces* lipases (WO10/065455), cutinase from *Magnaporthe grisea* (WO10/107560), cutinase from *Pseudomonas mendocina* (U.S. Pat. No. 5,389,536), lipase from *Thermobifida fusca* (WO11/084412), *Geobacillus stearothermophilus* lipase (WO11/084417), lipase from *Bacillus subtilis* (WO11/084599), and lipase from *Streptomyces griseus* (WO11/150157) and *S. pristinaespiralis* (WO12/137147).

Other examples are lipase variants such as those described in EP407225, WO92/05249, WO94/01541, WO94/25578, WO95/14783, WO95/30744, WO95/35381, WO95/22615, WO96/00292, WO97/04079, WO97/07202, WO00/34450, WO00/60063, WO01/92502, WO07/87508 and WO09/109500.

Preferred commercial lipase products include include Lipolase™, Lipex™; Lipolex™ and Lipoclean™ (Novozymes A/S), Lumafast (originally from Genencor) and Lipomax (originally from Gist-Brocades).

Still other examples are lipases sometimes referred to as acyltransferases or perhydrolases, e.g. acyltransferases with homology to *Candida antarctica* lipase A (WO10/111143), acyltransferase from *Mycobacterium smegmatis* (WO05/56782), perhydrolases from the CE 7 family (WO09/67279), and variants of the *M. smegmatis* perhydrolase in particular the S54V variant used in the commercial product Gentle Power Bleach from Huntsman Textile Effects Pte Ltd (WO10/100028).

Amylases

Suitable amylases which can be used may be an alpha-amylase or a glucoamylase and may be of bacterial or fungal origin. Chemically modified or protein engineered mutants are included. Amylases include, for example, alpha-amylases obtained from *Bacillus*, e.g., a special strain of *Bacillus licheniformis*, described in more detail in GB 1,296,839.

Suitable amylases include amylases having SEQ ID NO: 2 in WO 95/10603 or variants having 90% sequence identity to SEQ ID NO: 3 thereof. Preferred variants are described in WO 94/02597, WO 94/18314, WO 97/43424 and SEQ ID NO: 4 of WO 99/019467, such as variants with substitutions in one or more of the following positions: 15, 23, 105, 106, 124, 128, 133, 154, 156, 178, 179, 181, 188, 190, 197, 201, 202, 207, 208, 209, 211, 243, 264, 304, 305, 391, 408, and 444.

Different suitable amylases include amylases having SEQ ID NO: 6 in WO 02/010355 or variants thereof having 90% sequence identity to SEQ ID NO: 6. Preferred variants of SEQ ID NO: 6 are those having a deletion in positions 181 and 182 and a substitution in position 193.

Other amylases which are suitable are hybrid alpha-amylase comprising residues 1-33 of the alpha-amylase derived from *B. amyloliquefaciens* shown in SEQ ID NO: 6 of WO 2006/066594 and residues 36-483 of the *B. licheniformis* alpha-amylase shown in SEQ ID NO: 4 of WO 2006/066594 or variants having 90% sequence identity thereof.

Preferred variants of this hybrid alpha-amylase are those having a substitution, a deletion or an insertion in one of more of the following positions: G48, T49, G107, H156, A181, N190, M197, I201, A209 and Q264. Most preferred variants of the hybrid alpha-amylase comprising residues 1-33 of the alpha-amylase derived from *B. amyloliquefaciens* shown in SEQ ID NO: 6 of WO 2006/066594 and residues 36-483 of SEQ ID NO: 4 are those having the substitutions:

M197T;

H156Y+A181T+N190F+A209V+Q264S; or

G48A+T49I+G107A+H156Y+A181T+N190F+I201F+A209V+Q264S.

Further amylases which are suitable are amylases having SEQ ID NO: 6 in WO 99/019467 or variants thereof having 90% sequence identity to SEQ ID NO: 6. Preferred variants of SEQ ID NO: 6 are those having a substitution, a deletion or an insertion in one or more of the following positions: R181, G182, H183, G184, N195, I206, E212, E216 and K269. Particularly preferred amylases are those having deletion in positions R181 and G182, or positions H183 and G184.

Additional amylases which can be used are those having SEQ ID NO: 1, SEQ ID NO: 3, SEQ ID NO: 2 or SEQ ID NO: 7 of WO 96/023873 or variants thereof having 90% sequence identity to SEQ ID NO: 1, SEQ ID NO: 2, SEQ ID NO: 3 or SEQ ID NO: 7. Preferred variants of SEQ ID NO: 1, SEQ ID NO: 2, SEQ ID NO: 3 or SEQ ID NO: 7 are those having a substitution, a deletion or an insertion in one or more of the following positions: 140, 181, 182, 183, 184, 195, 206, 212, 243, 260, 269, 304 and 476, using SEQ ID 2 of WO 96/023873 for numbering. More preferred variants are those having a deletion in two positions selected from 181, 182, 183 and 184, such as 181 and 182, 182 and 183, or positions 183 and 184. Most preferred amylase variants of SEQ ID NO: 1, SEQ ID NO: 2 or SEQ ID NO: 7 are those having a deletion in positions 183 and 184 and a substitution in one or more of positions 140, 195, 206, 243, 260, 304 and 476.

Other amylases which can be used are amylases having SEQ ID NO: 2 of WO 08/153815, SEQ ID NO: 10 in WO 01/66712 or variants thereof having 90% sequence identity to SEQ ID NO: 2 of WO 08/153815 or 90% sequence identity to SEQ ID NO: 10 in WO 01/66712. Preferred variants of SEQ ID NO: 10 in WO 01/66712 are those having a substitution, a deletion or an insertion in one of more of the following positions: 176, 177, 178, 179, 190, 201, 207, 211 and 264.

Further suitable amylases are amylases having SEQ ID NO: 2 of WO 09/061380 or variants having 90% sequence identity to SEQ ID NO: 2 thereof. Preferred variants of SEQ ID NO: 2 are those having a truncation of the C-terminus and/or a substitution, a deletion or an insertion in one of more of the following positions: Q87, Q98, S125, N128, T131, T165, K178, R180, S181, T182, G183, M201, F202, N225, S243, N272, N282, Y305, R309, D319, Q320, Q359, K444 and 6475. More preferred variants of SEQ ID NO: 2 are those having the substitution in one of more of the following positions: Q87E,R, Q98R, S125A, N128C, T131I, T165I, K178L, T182G, M201L, F202Y, N225E,R, N272E, R, S243Q,A,E,D, Y305R, R309A, Q320R, Q359E, K444E and G475K and/or deletion in position R180 and/or S181 or of T182 and/or G183. Most preferred amylase variants of SEQ ID NO: 2 are those having the substitutions:

N128C+K178L+T182G+Y305R+G475K;

N128C+K178L+T182G+F202Y+Y305R+D319T+G475K;

S125A+N128C+K178L+T182G+Y305R+G475K; or

S125A+N128C+T131I+T165I+K178L+T182G+Y305R+G475K, wherein the variants are C-terminally truncated and optionally further comprise a substitution at position 243 and/or a deletion at position 180 and/or position 181.

Further suitable amylases are amylases having SEQ ID NO: 1 of WO13184577 or variants having 90% sequence identity to SEQ ID NO: 1 thereof. Preferred variants of SEQ ID NO: 1 are those having a substitution, a deletion or an insertion in one of more of the following positions: K176, R178, G179, T180, G181, E187, N192, M199, I203, S241, R458, T459, D460, G476 and G477. More preferred variants of SEQ ID NO: 1 are those having the substitution in one of more of the following positions: K176L, E187P, N192FYH, M199L, I203YF, S241QADN, R458N, T459S, D460T, G476K and G477K and/or deletion in position R178 and/or S179 or of T180 and/or G181.

Most preferred amylase variants of SEQ ID NO: 1 are those having the substitutions:

E187P+I203Y+G476K

E187P+I203Y+R458N+T459S+D460T+G476K, wherein the variants optionally further comprises a substitution at position 241 and/or a deletion at position 178 and/or position 179.

Further suitable amylases are amylases having SEQ ID NO: 1 of WO10104675 or variants having 90% sequence identity to SEQ ID NO: 1 thereof. Preferred variants of SEQ ID NO: 1 are those having a substitution, a deletion or an insertion in one of more of the following positions: N21, D97, V128 K177, R179, S180, I181, G182, M200, L204, E242, G477 and G478.

More preferred variants of SEQ ID NO: 1 are those having the substitution in one of more of the following positions: N21D, D97N, V128I K177L, M200L, L204YF, E242QA, G477K and G478K and/or deletion in position R179 and/or S180 or of I181 and/or G182. Most preferred amylase variants of SEQ ID NO: 1 are those having the substitutions:

N21D+D97N+V128I, wherein the variants optionally further comprises a substitution at position 200 and/or a deletion at position 180 and/or position 181.

Other suitable amylases are the alpha-amylase having SEQ ID NO: 12 in WO01/66712 or a variant having at least 90% sequence identity to SEQ ID NO: 12. Preferred amylase variants are those having a substitution, a deletion or an insertion in one of more of the following positions of SEQ ID NO: 12 in WO01/66712: R28, R118, N174; R181, G182, D183, G184, G186, W189, N195, M202, Y298, N299, K302, S303, N306, R310, N314; R320, H324, E345, Y396, R400, W439, R444, N445, K446, Q449, R458, N471, N484. Particular preferred amylases include variants having a deletion of D183 and G184 and having the substitutions R118K, N195F, R320K and R458K, and a variant additionally having substitutions in one or more position selected from the group: M9, G149, G182, G186, M202, T257, Y295, N299, M323, E345 and A339, most preferred a variant that additionally has substitutions in all these positions.

Other examples are amylase variants such as those described in WO2011/098531, WO2013/001078 and WO2013/001087.

Commercially available amylases are Duramyl™, Termamyl™, Fungamyl™, Stainzyme™, Stainzyme Plus™, Natalase™, Liquozyme X and BAN™ (from Novozymes A/S), and Rapidase™, Purastar™/Effectenz™, Powerase, Preferenz S1000, Preferenz S100 and Preferenz S110 (from Genencor International Inc./DuPont).

Peroxidases/Oxidases

A peroxidase can be a peroxidase enzyme comprised by the enzyme classification EC 1.11.1.7, as set out by the Nomenclature Committee of the International Union of Biochemistry and Molecular Biology (IUBMB), or any fragment derived therefrom, exhibiting peroxidase activity.

Suitable peroxidases include those of plant, bacterial or fungal origin. Chemically modified or protein engineered mutants are included. Examples of useful peroxidases include peroxidases from *Coprinopsis*, e.g., from *C. cinerea* (EP 179,486), and variants thereof as those described in WO 93/24618, WO 95/10602, and WO 98/15257.

A peroxidase can also be a haloperoxidase enzyme, such as chloroperoxidase, bromoperoxidase and compounds exhibiting chloroperoxidase or bromoperoxidase activity. Haloperoxidases are classified according to their specificity for halide ions. Chloroperoxidases (E.C. 1.11.1.10) catalyze formation of hypochlorite from chloride ions.

The haloperoxidase can be a chloroperoxidase. Preferably, the haloperoxidase is a vanadium haloperoxidase, i.e., a vanadate-containing haloperoxidase. Preferably the vanadate-containing haloperoxidase is combined with a source of chloride ion.

Haloperoxidases have been isolated from many different fungi, in particular from the fungus group dematiaceous hyphomycetes, such as *Caldariomyces*, e.g., *C. fumago, Alternaria, Curvularia*, e.g., *C. verruculosa* and *C. inaequalis, Drechslera, Ulocladium* and *Botrytis*.

Haloperoxidases have also been isolated from bacteria such as *Pseudomonas*, e.g., *P. pyrrocinia* and *Streptomyces*, e.g., *S. aureofaciens*.

Preferably, the haloperoxidase is derivable from *Curvularia* sp., in particular *Curvularia verruculosa* or *Curvularia inaequalis*, such as *C. inaequalis* CBS 102.42 as described in WO 95/27046; or *C. verruculosa* CBS 147.63 or *C. verruculosa* CBS 444.70 as described in WO 97/04102; or from *Drechslera hartlebii* as described in WO 01/79459, *Dendryphiella salina* as described in WO 01/79458, *Phaeotrichoconis crotalarie* as described in WO 01/79461, or *Geniculosporium* sp. as described in WO 01/79460.

An oxidase according to the invention includes, in particular, any laccase enzyme comprised by the enzyme classification EC 1.10.3.2, or any fragment derived therefrom exhibiting laccase activity, or a compound exhibiting a similar activity, such as a catechol oxidase (EC 1.10.3.1), an o-aminophenol oxidase (EC 1.10.3.4), or a bilirubin oxidase (EC 1.3.3.5).

Preferred laccase enzymes are enzymes of microbial origin. The enzymes may be derived from plants, bacteria or fungi (including filamentous fungi and yeasts).

Suitable examples from fungi include a laccase derivable from a strain of *Aspergillus, Neurospora*, e.g., *N. crassa, Podospora, Botrytis, Collybia, Fomes, Lentinus, Pleurotus, Trametes*, e.g., *T. villosa* and *T. versicolor, Rhizoctonia*, e.g., *R. solani, Coprinopsis*, e.g., *C. cinerea, C. comatus, C. friesii*, and *C. plicatilis, Psathyrella*, e.g., *P. condelleana, Panaeolus*, e.g., *P. papilionaceus, Myceliophthora*, e.g., *M. thermophila, Schytalidium*, e.g., *S. thermophilum, Polyporus*, e.g., *P. pinsitus, Phlebia*, e.g., *P. radiata* (WO 92/01046), or *Coriolus*, e.g., *C. hirsutus* (JP 2238885).

Suitable examples from bacteria include a laccase derivable from a strain of *Bacillus*.

A laccase derived from *Coprinopsis* or *Myceliophthora* is preferred; in particular a laccase derived from *Coprinopsis cinerea*, as disclosed in WO 97/08325; or from *Myceliophthora thermophila*, as disclosed in WO 95/33836.

According to an embodiment of the present invention, the antistatic surface is provided by means of an antistatic coating or an antistatic film forming the inner surface of the container or an antistatic agent incorporated in the plastic material forming the inner surface of the container.

Preferably, the surface resistivity of the antistatic inner surface is lower than $5\times10^{12}$ ohm/cm$^2$, preferably between $1\times10^{9}$ ohm/cm$^2$ and $1\times10^{12}$ ohm/cm$^2$, alternatively between $1\times10^{10}$ ohm/cm$^2$ and $1\times10^{12}$ ohm/cm$^2$, or alternatively between $1\times10^{11}$ ohm/cm$^2$ and $1\times10^{12}$ ohm/cm$^2$ as measured according to ASTM D 257.

According to a further embodiment of the present invention the inner surface has a surface tension in the range of 40-50 dyne/cm, alternatively 42-46 dyne/cm or alternatively 44-45 dyne/cm, as measured according to ASTM D 2578.

In order to further improve the emptying of the container, the inner surface can have a coefficient of static friction between 45 and 55 and a coefficient of dynamic friction between 40 and 50 as measured according to ASTM D 1894.

According to a further embodiment, at least the circumferential wall is translucent or transparent. As a result, it is possible to follow the emptying of the container and to observe whether any enzymes are still present in the container.

According to a further embodiment of the invention, the container comprises a top wall joining the upper end of the circumferential wall.

The top wall can have an outline and preferably also a size essentially corresponding to the outline and size of the bottom wall.

According to an additional embodiment of the present invention, the closable outlet member comprises an outwardly extending collar or spout closed by a cover.

The cover can be a lid or cap connected to the spout or collar by means of a snap fit or a screw connection or a bayonet connection.

Further, the cover can comprise a foil peelably connected to the edge of the spout or collar so as to close the outlet opening of the spout or collar or a pierceable foil non-peelably connected to the edge of the spout or collar so as to close the outlet opening thereof.

The spout or collar of the container can be provided with both a peelable foil and a lid or cap or alternatively both a non-peelable pierceable foil and a lid or cap, e.g. a pierceable foil which is pierced when the cap is unscrewed from the spout Additionally, the closeable outlet member of the container can comprise a valve allowing for opening and closing the outlet opening of the spout or collar. As an example, the valve can comprise a plate fixed to the outlet of the spout or collar and being provided with an excentrically arranged first opening and a cap or lid being rotatable arranged relative to the plate and the collar or spout, the cap being provided with an excentrically arranged second opening in the top wall thereof, the cap being rotatable between an open position in which the second opening registers with, i.e. overlaps, the first opening and a closed position in which the second opening does not overlap the first opening.

According to an at present preferred embodiment, the container is a bag formed from flexible heat-sealable plastic film and provided with a carrying handle, preferably of plastic film, the carrying handle being preferably attached to the circumferential wall.

Many combinations of polymer layers and polymer films are in principle suitable as plastic film for the container according to the invention in the form of a bag.

According to the present invention, the plastic film may comprise a first film layer, preferably a bi-axially oriented film layer, the first film layer preferably being the inner film layer of the plastic film and providing the inner antistatic surface, an antistatic additive being incorporated in the first film layer, or an antistatic coating being applied to the first film layer, the plastic film optionally comprising additional layers arranged outwardly of the first film layer.

Further, the inner film layer of the plastic film can be a film layer of polyethylene terephthalate (PET), preferably a bi-axially oriented PET-film, the PET-film preferably being the inner layer of the plastic film and providing the inner antistatic surface, an antistatic additive being incorporated in the PET-film, or an antistatic coating being applied to the PET film, the plastic film optionally comprising additional layers arranged outwardly of the PET-film.

Additionally, the first film layer of the plastic film could be a film layer of polypropylene (PP) or polyamide (PA), preferably oriented such as bi-axially oriented PP or PA, i.e. OPP or OPA, although at present it is preferred that the plastic film comprises a PET layer due to the high tensile strength of this polymer. The plastic film can also comprise other or additional polymer layers such as a polyethylene (PE) layer.

It should be noted that the first layer, such as the PET layer, could also be an interior layer where at least one film layer is arranged on the inwardly facing side thereof and the antistatic surface is provided by said at least one film layer or an antistatic coating on the inwardly facing side thereof.

Finally, it should be noted that the inner layer, such as the PET layer, should be a sealable layer, i.e. a weldable layer, preferably a heat sealable layer or provided with such a layer in order to allow the plastic film to provide a strong seal when sealed, i.e. welded, inner face towards inner face. An antistatic additive can be incorporated in the sealing layer.

An example of suitable transparent plastic films comprising a bi-axially oriented PET-film and an inner antistatic coating forming the inner surface of the plastic film is the antistatic coated polyester films PETLAR-PAT from the company SRF Limited.

In general, it is preferred that the plastic film and/or the first film thereof has a tensile strength between 1200 and 2700 kg/cm2, alternatively between 1500 and 2700 kg/cm2, alternatively between 1700 and 2700 kg/cm2, alternatively between 1800 and 2700 kg/cm2.

In an at present preferred embodiment, the bag is formed of a plastic film comprising the following layers as seen from the inner of the bag to the outer thereof: 12μ PET antistatic/15μ OPA/140μ PE transparent antistatic.

According to an embodiment of the present invention, the container is a stand-up bag and the circumferential wall is formed by a front and a back panel of plastic film being joined at longitudinal edges by longitudinal welding seams and joined at upper and lower edges, and a bottom wall is formed by an inwardly folded lower end panel of plastic film extending between and joined to the lower edges of the front and back panels by lower transverse welding seams.

The front and back panel can be joined at the upper end by a transverse welding seam, the outlet member being positioned and leak-proof joined between the front and back walls, the transverse welding seam preferably extending downwardly divergent, i.e. sloping, from the outlet member towards the respective longitudinal edges.

In this way, the front and back panels extend convergingly from the bottom wall to the top of the bag as seen in a lateral view and the upper portion of the bag assumes a funnel shape when the bag is turned upside down. As a result, emptying of the bag is improved The outlet is preferably arranged centrally of the upper edges of the panels.

The bag-shaped container is especially suited for amounts of polypeptide, such as a content of less 30 l., such as 3-25 l., alternatively 3-20 l., 3-15 l., 3-10 l., or 3-6 l.

According to an at present preferred embodiment, a top wall of the bag is formed by an inwardly folded upper end panel of plastic film extending between and joined to the upper edges of the front and back panel by upper transverse welding seams, the outlet member being positioned and leak-proof joined between the upper end panel and the upper edge of the front panel, the transverse welding seam between the front panel and the upper end panel preferably extending downwardly diverging, i.e. sloping, from the outlet member towards the respective longitudinal edges.

In this way, the container assumes, in the filled state thereof, essentially a box or can shape and the upper portion of the bag assumes a funnel shape when the bag is turned upside down. As a result, emptying of the bag is improved.

The outlet member is preferably arranged centrally of the upper edges of the panels.

The carrying handle is attached to the back panel.

According to an additional embodiment of the present invention, the container is a rigid container formed from a preferably thermoplastic plastic material.

Suitable materials for the rigid container are HDPE (High Density Polyethylene) and PP (Polypropylene).

The outlet member can be formed in the top wall of the container, the top wall preferably having an inner surface sloping downwardly from the outlet member towards the circumferential wall.

Thereby, the inner surface of the top wall defines a shape corresponding to that of a funnel when the container is turned upward down.

The outlet is preferably arranged centrally of the top wall.

The rigid container can be formed from a first essentially bowl-shaped part having a first bottom, a first side wall and a first upper rim and an essentially bowl-shaped second part having a second bottom, a second side wall and a second upper rim, the first and the second upper rims having essentially the same shapes and sizes and the first rim of the first bowl-shaped part being leak-proof connected to the second rim of the bowl-shaped second part.

In this way, the top wall and an upper portion of the circumferential wall of the container are formed by the first bowl-shaped part and the bottom wall, and the lower portion of the circumferential wall of the container is formed by the second bowl-shaped part.

It is preferred that the side walls of both the first and the second bowl-shaped part extend divergingly from the bottom towards the rim, thereby allowing the first and second bowl-shaped parts to be nested.

Alternatively, the container can be formed by a bowl-shaped lower part and a lid-shaped upper part leak-proof connected to the upper rim of the bowl-shaped part.

Independent of the shapes or types of the two parts, the connection between the two parts can be a permanent connection provided by adhesion or welding of the two parts or a releasable connection that can be re-established and comprises a sealing means.

The rigid container is especially suited for containing a large amount of polypeptide such as 20-80 l., alternatively 30-60 l. or 40-50 l.

The present invention further relates to a method of dispensing polypeptide stored in a container according to the present invention, comprising the steps of:

a) leak-proof connecting the outlet member and a mating coupling member, the coupling member being a part of a receiving vessel to which the polypeptide is to be dispensed or a part of a tube connected to the vessel to which the polypeptide is to dispensed, b) placing the container so that the outlet opening of the outlet member of the container faces downwardly, and thereby allowing the polypeptide to flow by gravity from the container to the receiving vessel.

It should be noted that step a) is obviously carried out after a free passage has been provided through the outlet opening so that the polypeptide can flow out of the container through the outlet opening of the outlet member of the container. In other words, any cover or restriction of the outlet member has been removed. As an example, a foil closing the outlet opening of a spout or collar has been removed or pierced, a screw cap or lid closing the outlet opening of the spout or collar has been removed and a valve arranged in the outlet member has been moved to its open position etc.

Preferably, the container is shaken after it has been placed with the outlet opening facing downwardly and polypeptide is dispensed in order to thereby assist in dispensing the granular or powdery polypeptide.

After the polypeptide has been dispensed, the mating coupling member is disconnected from the outlet member of the container. The outlet member, such as a collar or spout, can be reclosed, such as by a lid or cap, initially closing the outlet opening of the outlet member of the container. When being a bag formed of a flexible plastic material, the container can, after having been emptied, be folded up or rolled up while still being connected to the mated member, where after it is disconnected from the mating member, and the outlet opening of the outlet member, such as a collar or a spout, is reclosed by the lid or cap initially closing the outlet opening.

Finally, the reclosed container in the form of a bag can be disposed.

Finally, the present invention relates to a system comprising a container according to the present invention and a coupling member configured to be leak-proof mated with the outlet member of the container, the mating coupling member being arranged on a receiving vessel configured to receive the polypeptide stored in the container or being arranged at a first end of a tube having an opposite second end connected to or connectable to the receiving vessel.

BRIEF DESCRIPTION OF THE FIGURES

Embodiments of the invention will be described in more detail in the following with regard to the accompanying figures. The figures show one way of implementing the present invention and are not to be construed as being limiting to other possible embodiments falling within the scope of the attached claim set.

DETAILED DESCRIPTION OF THE INVENTION

Figure 1:
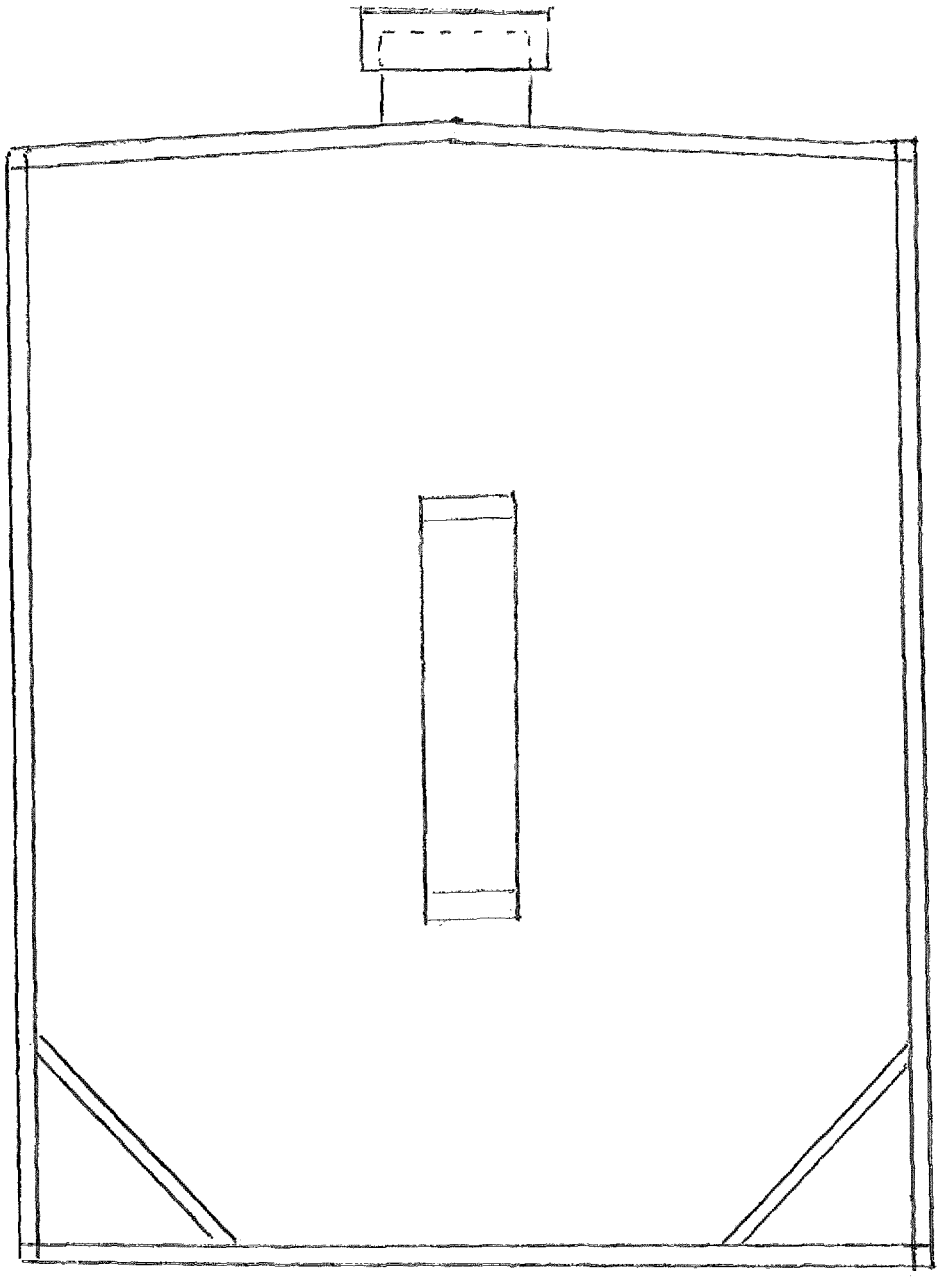
FIG. 1 is a view of a first embodiment of the container according to the invention formed as a stand-up bag, as seen towards the back thereof.
Figure 2:
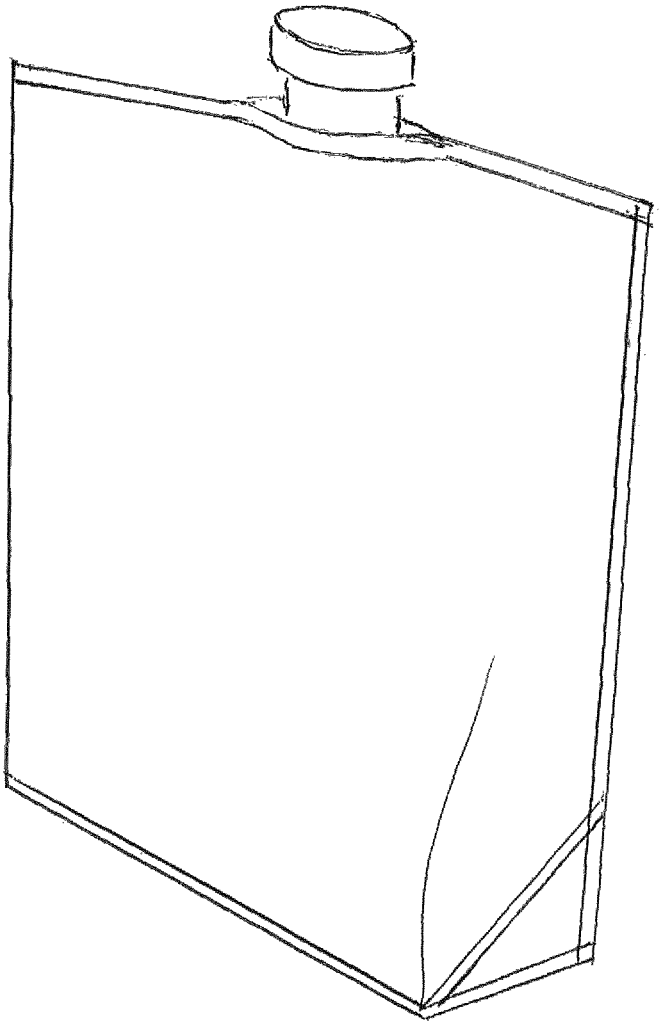
FIG. 2 is a diagrammatical perspective view of the stand-up bag shown in FIG. 1.

FIGS. 1 and 2 disclose a first embodiment of a container according to the invention in the form of a stand-up bag 1. The bag is formed from a flexible heat-sealable plastic film being a bi-axially oriented PET-film with an antistatic coating forming the inner surface of the bag 1. The bag comprises a circumferential wall 2 formed by a front panel 3 and a back panel 4 of the plastic film. The front panel 3 and the back panel 4 are joined at longitudinal edges by longitudinal welding seams 5,6. Additionally, the front and back panels are joined at upper and lower edges.

A bottom wall 7 of the bag 1 is formed by an inwardly folded lower end panel 9 of plastic film extending between and joined to the lower edges of the front and back panels 3,4 by lower transverse welding seams 10,11. Additionally, the lower end panel is joined to the front and back panels 3,4 by angled corner welding seams extending between a lower transverse welding seam 10,11 and the adjacent longitudinal welding seam 5,6. Only the corner welding seams 12,13,14 are visible in FIGS. 1 and 2.

The front and the back panels are directly joined at the upper end by an upper transverse welding seam 15 and an outlet member 16 is positioned and leak-proof joined between the front panel 3 and the back panel 4 by means of the upper transverse welding seam 15. The upper transverse welding seam 15 extends upwardly converging from the respective longitudinal welding seam 5,6 towards the outlet member 16 being centrally arranged, i.e. sloping downwardly from the outlet member 16 towards the respective longitudinal welding seam 5,6. As a result, when the bag 1 is turned upside down, the front and back panels 3,4 extend convergingly from the bottom wall 7 towards the upper transverse welding seam 15 as seen in a lateral view and the transverse upper welding seam slopes downwardly towards the outlet member 16 so that the upper portion of the bag assumes a funnel shape.

Further and as seen from FIG. 1, the bag 1 is provided with a carrying handle 17 of plastic film, the handle 17 being arranged centrally on the back panel 4.

Figure 5:
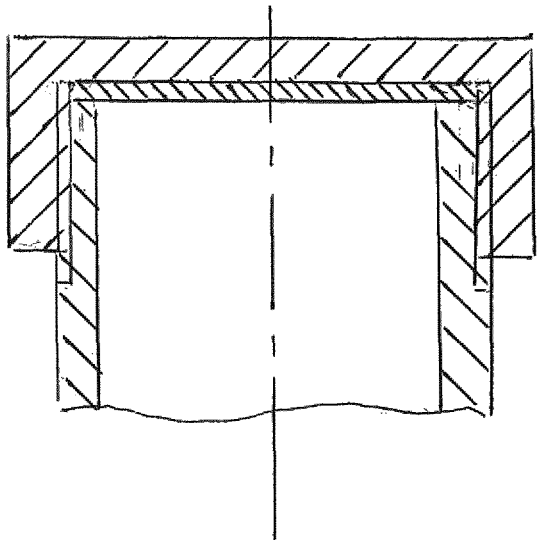
FIG. 5 is longitudinal sectional view of an upper portion of a first outlet member of a container according to the invention.

Reference is now made to FIG. 5 disclosing in more details the outlet member 16 of the bag 1 in FIGS. 1 and 2. The outlet member comprises an outwardly extending spout 18 joined to the front and back panels by means of the upper transverse welding seam 15. The spout 18 is provided with an outlet opening 19 being at the upper end of the spout closed by a first cover in the form of a foil 20 peelably joined to the upper edge of the spout. The outlet member 16 further comprises a screw cap screwed onto an outer thread 22 on the outer end portion of the spout 18.

Figure 6:
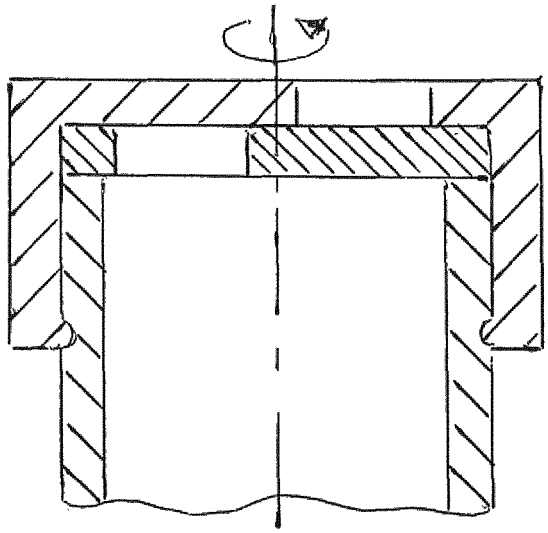
FIG. 6 is longitudinal sectional view of an upper portion of a second outlet member of a container according to the invention.

FIG. 6 discloses an alternative outlet member 23 functioning as a valve. The alternative outlet member 23 comprises an outwardly extending collar 24 being at the outer end thereof provided with an end wall 25 closing the outlet opening 26 of the collar and being provided with a an excentrically arranged first opening 27. A rotatable cap 28 is arranged rotatably on the outer end portion of the collar 24 and is provided with an excentrically arranged second opening in the top wall 30 of the cap 28. The lower surface of the top wall is in leak-proof engagement with the upper surface of the end wall 25. The cap 28 is rotatable between open position (not shown) in which the second opening 29 is in register with, i.e. overlaps, the first opening 27 and a closed position in which the second opening 29 does not overlap the first opening 27.

Figure 3:
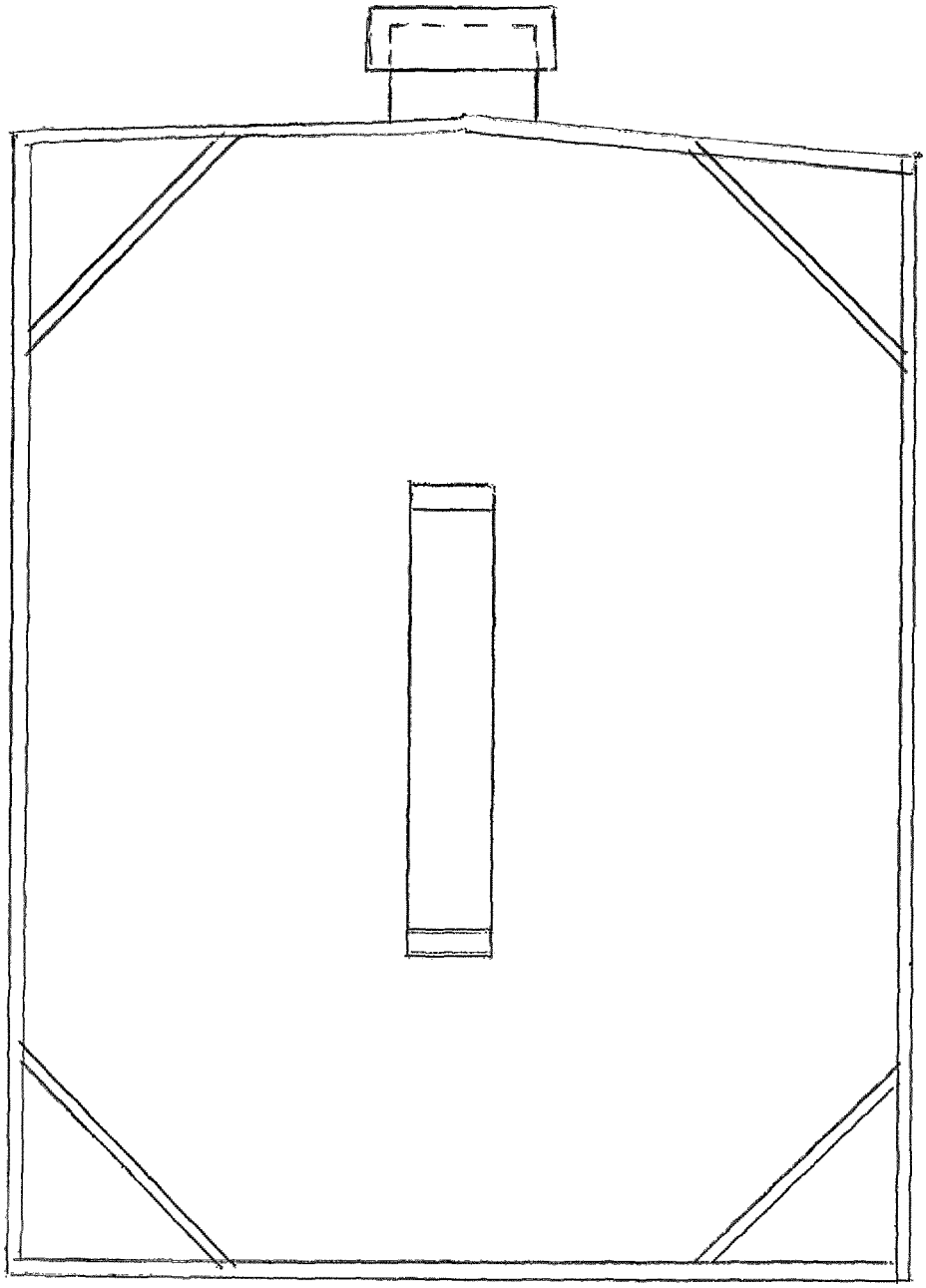
FIG. 3 is a view of a second embodiment of the container according to the invention formed as a stand-up bag, as seen towards the back thereof.
Figure 4:
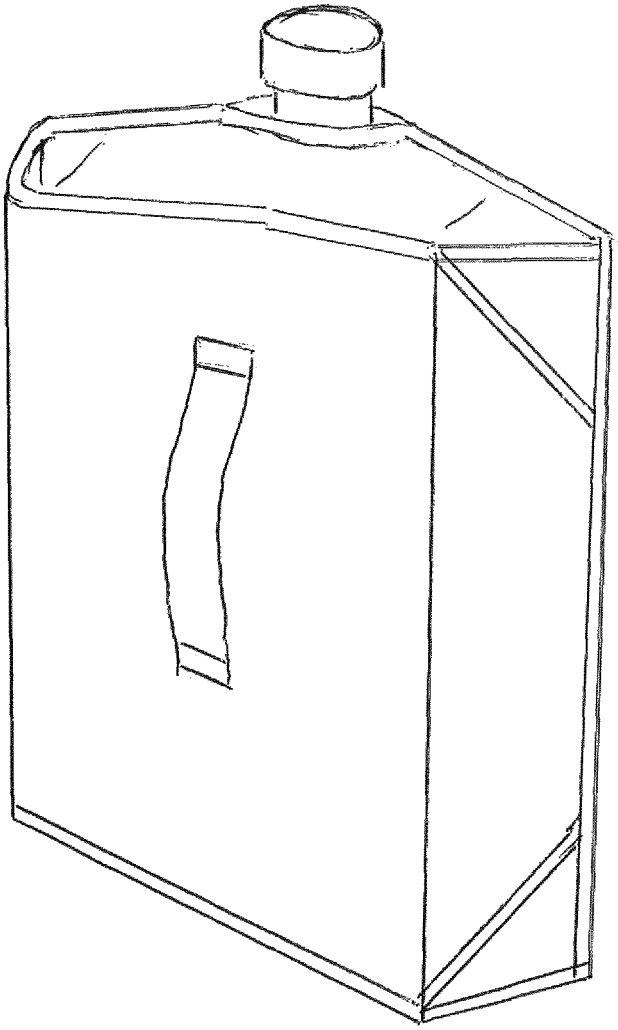
FIG. 4 is a diagrammatical perspective view of the stand-up bag shown in FIG. 3.

FIGS. 3 and 4 disclose a second embodiment of the container according to the invention in the form of a stand-up bag 31. The bag is formed from a flexible heat-sealable plastic film being a bi-axially oriented PET-film with a antistatic coating forming the inner surface of the bag 31. The bag 31 comprises a circumferential wall 32 formed a front panel 33 and a back panel 34 of the plastic film. The front panel 33 and the back panel 34 are joined at longitudinal edges by longitudinal welding seams 35,36. Additionally, the front and back panel 35,36 are joined at upper and lower edges.

A bottom wall 37 of the bag 31 is formed by an inwardly folded lower end panel 39 of plastic film extending between and joined to the lower edges of the front and back panel 33,34 by lower transverse welding seams 40,41. Additionally, the lower end panel is joined to the front and back panels 33,34 by angled corner welding seams extending between a lower transverse welding seam 40,41 and the adjacent longitudinal welding seam 35,36. Only the corner welding seams 42,43,44 are visible in FIGS. 3 and 4.

A top wall 49 of the bag 31 is formed by a inwardly folded upper end panel 50 of plastic film extending between and joined to the upper edges of the front and back panels 33,34 by upper transverse welding seams 52, 53. An outlet member 46 is positioned and leak-proof joined between the upper end panel 50 and the upper edge of the front panel 33 by means of the upper transverse welding seam 53. Additionally, the upper end panel 50 is joined to the front and the back panels 33,34 by means of upper angled corner seams 54,55,56 extending between an upper transverse welding seam 52,53 and an adjacent longitudinal welding seam 35,36.

The upper transverse welding seam 45 extends upwardly converging from the respective longitudinal welding seam 35,36 towards the outlet member 46 being centrally arranged, i.e. sloping downwardly from the outlet member 46 towards the respective longitudinal welding seam 35,36. As a result, when the bag 31 is turned upside down, the transverse upper welding seam slopes downwardly towards the outlet member 46 so that the upper portion of the bag assumes a funnel shape. The outlet member comprises an outwardly extending spout 48 being at the upper end thereof provided with a screw cap 51. The outlet spout could alternatively be formed as described with reference to FIG. 4 or 5.

Further and as seen from FIG. 3, the bag 31 is provided with a carrying handle 47 of plastic film, the handle 47 being arranged centrally on the back panel 44.

Figure 13:
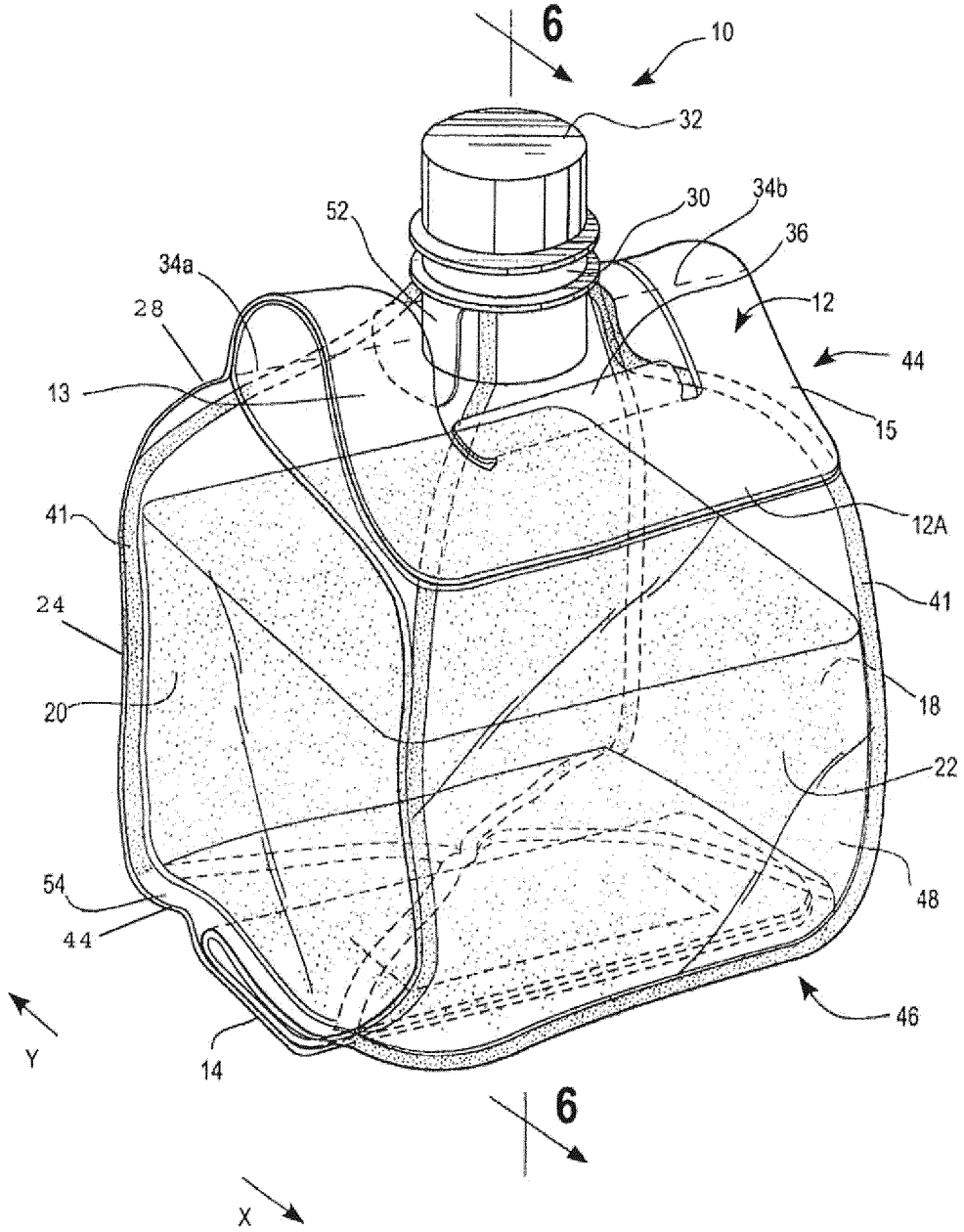
FIG. 13 shows a perspective view of a prior art flexible container as shown in FIG. 1 in WO 2011/031343 A1.

The closed and sealed, preferably thermoplastic, container according to the invention in the form of bag storing a powdery or granular polypeptide may for example be shaped as a flexible container as shown in WO 2011/031343 A1, where the shown container according to the present invention is additionally provided with an inner surface being an antistatic surface adapted to be in contact with the polypeptide. Such a bag is shown in FIG. 13 corresponding to FIG. 1 of WO 2011/031343 A1.

It should be understood that features described for a container according to the present invention (such as the antistatic inner surface, the different layers of the plastic film, the outlet member etc.), are also usable for the above-mentioned embodiment based on the flexible container according to WO 2011/031343 A1, said flexible container being additionally provided with an inner surface being an antistatic surface adapted to be in contact with polypeptide.

Figure 7:
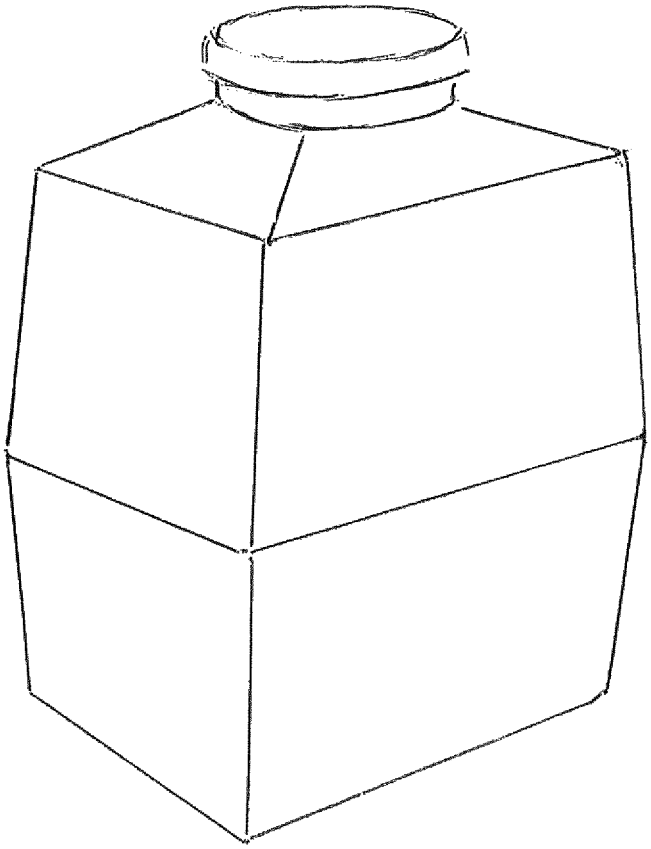
FIG. 7 is a diagrammatical perspective view of a third embodiment of a container according to the invention formed as a rigid box-shaped container.
Figure 8:
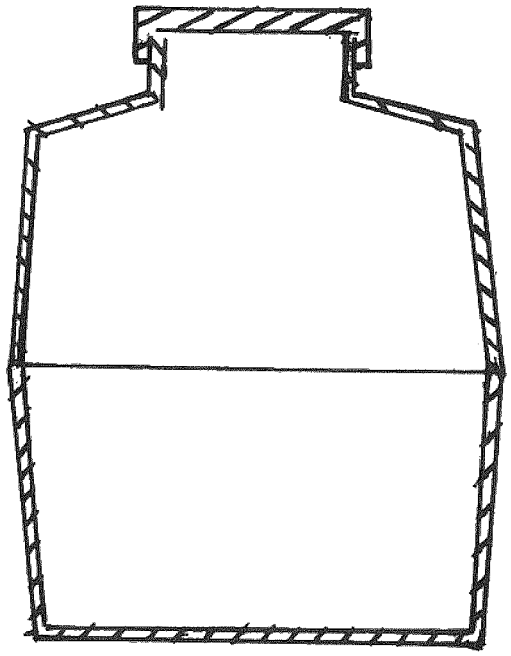
FIG. 8 is a longitudinal sectional view of the container shown in FIG. 7, FIGS. 9-12 illustrate the steps in the method according to the invention for dispensing polypeptide stored in a container according to the invention to a vessel and additionally a system according to the invention comprising a container according to the invention and a coupling member to be connected to the outlet member of the container.

Reference is now made to FIGS. 7 and 8 disclosing an embodiment of the container according to the present invention in the form of a rigid container 61 made from a thermoplastic polymer, e.g. HDPE or PP, and has an inner surface formed by an antistatic coating. The rigid container 61 comprises a circumferential wall 62 having an upper portion 63 and a lower portion 66. The upper portion 53 extends upwardly converging towards a top wall 64 extending convergingly towards the midpoint thereof where an outlet member 65 is arranged. The lower portion 66 of the circumferential wall 62 extends downwardly converging towards an essentially planar bottom wall 67.

The outlet member 65 comprises a collar 68 extending outwardly from the top wall 64, the outlet opening thereof being leak-proof closed by a lid 69 being by means of a snap fit removably connected to the upper end portion of the collar. The outlet member could alternatively be formed as any of the previously described outlet members.

The rigid container is formed from a first essentially bowl-shaped part and a second essentially bowl-shaped part.

The first bowl-shaped part comprises a first end wall or bottom and a first side wall ending in a first upper rim. The second bowl-shaped part comprises a second end wall or bottom and a second side wall ending in a second upper rim. The first and the second upper rims have essentially the same sizes and shapes and are leak-proof mutually connected to form the rigid container. In this way, the top wall 64 and an upper portion 63 of the circumferential wall 62 of the container 61 are formed by the first bowl-shaped part and the bottom wall 67, and the lower portion 66 of the circumferential wall 62 of the container 61 is formed by the second bowl-shaped part.

Alternatively, the container can be formed by a bowl-shaped lower part and a lid-shaped upper part leak-proof connected to the upper rim of the bowl-shaped part.

Independent of the shapes or types of the two parts, the connection between the two parts can be a permanent connection provided by adhesion or welding of the two parts or a releasable connection that can be re-established and comprises a sealing means.

Reference is now made to FIGS. 9-12 illustrating the steps of a method according to the invention for dispensing the polypeptide contained in the container to a receiving vessel. The method is illustrated by reference to the stand-up bag 31 described previously with reference to FIGS. 3 and 4.

In an initial step, the screw cap 51 of the outlet member 48 is unscrewed from the spout 48. Should the spout be additionally closed by a peelable foil, the peelable foil is removed from the spout, see FIGS. 9 and 10. The outlet opening of the spout is now open.

A mating coupling member 70 is now leak-proof connected to the spout 48 of the outlet member 46. In the example illustrated, the mating coupling member 70 is arranged at a first end of a tube, the second end of the tube being connected to an receiving vessel 72 to which the polypeptide in the bag 31 is to be delivered, see FIG. 11. The connection between the spout of the bag and the mating coupling can be a screw connection. As an alternative to connecting the spout of the bag to a mating coupling member 70 being a part of a tube, the mating coupling member could be a part of the receiving vessel and the spout of the bag 31 be connected directly to the receiving vessel via the mating coupling member thereof.

Figure 11:
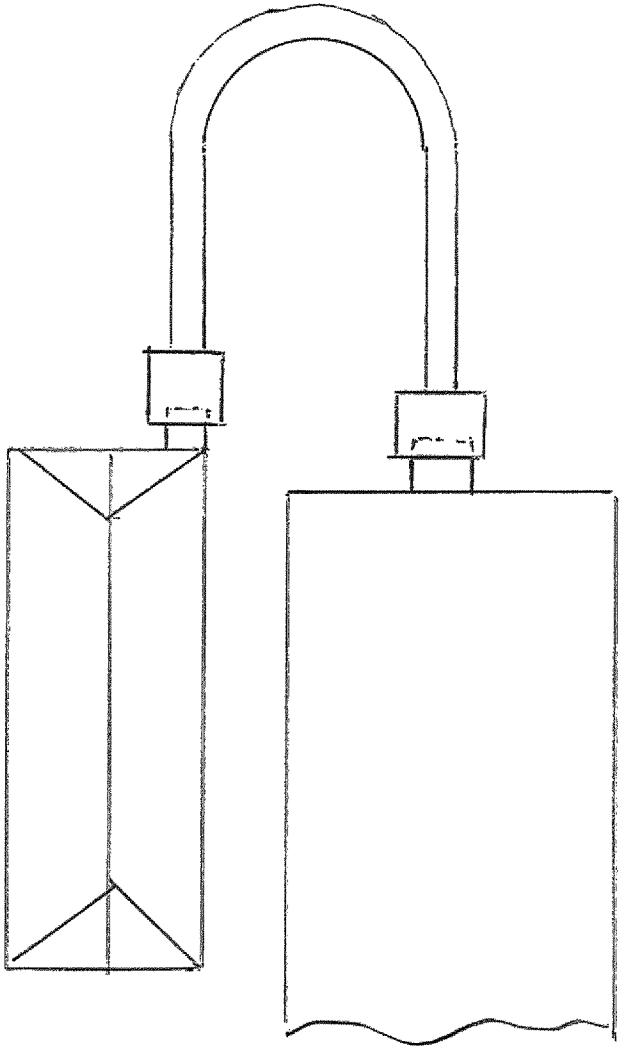
Figure 10:
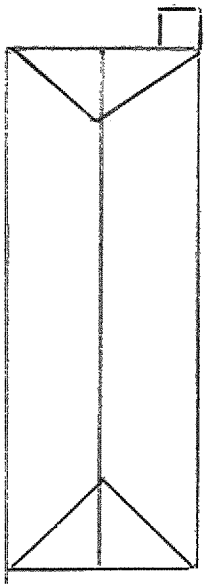
Figure 9:
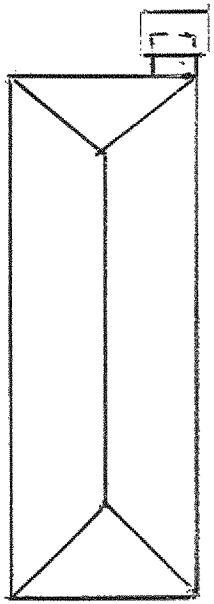
Figure 12:
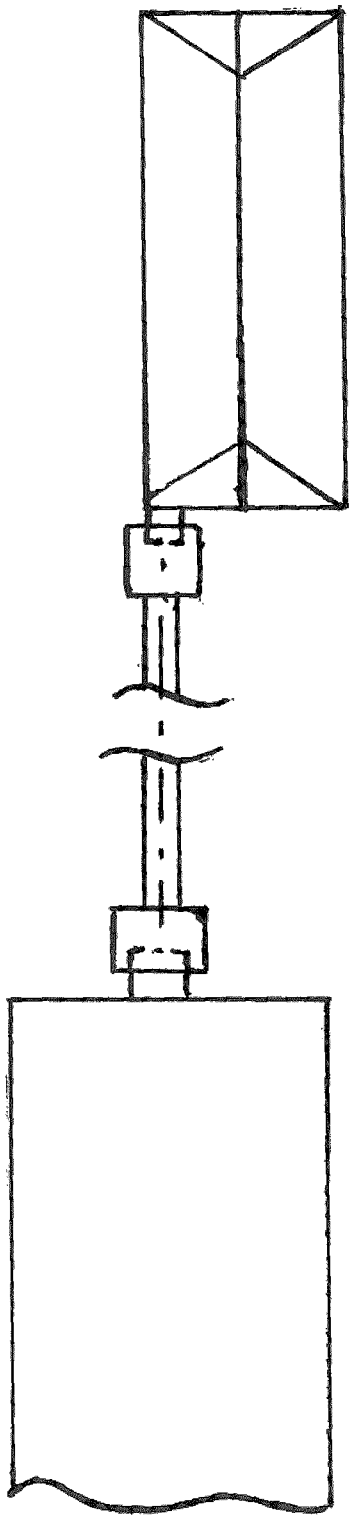

As a next step, the bag 31 is arranged so that the outlet opening of the spout faces downwardly, e.g. by turning the bag upside down as shown in FIG. 11 and arrange it above the receiving vessel 72, thereby allowing the powdery or granular polypeptide in the bag 31 to flow by gravity from the bag to the receiving vessel 72.

Finally, the bag is placed in an upright position, the mating coupling member 70 is removed from the spout of the bag and the screw cap is screwed unto the spout of the bag 31.

LIST OF REFERENCE NUMERALS

1 Bag
2 circumferential wall
3 front panel
4 back panel
5 longitudinal welding seam
6 longitudinal welding seam
7 bottom wall
9 lower panel
10 lower transverse welding seam
11 lower transverse welding seam
12 angled corner welding seam
13 angled corner welding seam
14 angled corner welding seam
15 upper transverse welding seam
16 outlet member
17 carrying handle
18 Spout
19 outlet opening
20 Foil
21 screw cap
22 outer thread
23 alternative outlet member
24 Collar
25 end wall
26 outlet opening
27 first opening
28 rotatable cap
29 second opening
30 top wall
31 Bag
32 circumferential wall
33 front panel
34 back panel
35 longitudinal welding seam
36 longitudinal welding seam
37 bottom wall
39 lower panel
40 lower transverse welding seam
41 lower transverse welding seam
42 angled corner welding seam
43 angled corner welding seam
44 angled corner welding seam
46 outlet member
47 carrying handle
48 Spout
49 top wall
50 upper end panel
51 screw cap
52 upper transverse welding seam
53 upper transverse welding seam
54 upper angled corner welding seam
55 upper angled corner welding seam
56 upper angled corner welding seam
61 rigid container
62 circumferential wall
63 upper portion
64 top wall
65 outlet member
66 lower portion
67 Bottom
68 Collar
69 Lid
70 mating coupling member
71 Tube
72 receiving vessel

The invention claimed is:

1. A closed and sealed plastic container (1,31) in which a powdery or granular polypeptide is stored, said container comprising a circumferential wall (2,32) having an upper end and a lower end and at the lower end joining a closed bottom wall (7,37) and being at the upper end provided with a closable outlet member (16,23,46) having an outlet opening (19,26), the container having an inner surface and an outer surface, the inner surface being an antistatic surface adapted to be in contact with the polypeptide.

2. A container according to claim 1, wherein the antistatic surface is provided by means of an antistatic coating or an antistatic film forming the inner surface of the container or an antistatic agent incorporated in the plastic material forming the inner surface of the container.

3. A container according to claim 2, wherein the surface resistivity of the antistatic inner surface is lower than $5\times10^{12}$ ohm/cm$^2$.

4. A container according to claim 1, wherein the inner surface has a coefficient of static friction between 45 and 55 and a coefficient of dynamic friction between 40 and 50 as measured according to ASTM D 1894.

5. A container according to claim 1, wherein the closable outlet member (16,23,26) comprises an outwardly extending collar or spout (18,24,48) closed by a cover (20,21,28).

6. A container according to claim 5, wherein the cover is a lid or cap (21,28) connected to the spout or collar by means of a snap fit or a screw connection or a bayonet connection.

7. A container according to claim 5, wherein the cover comprises a foil (20) peelably connected to the edge of the spout or collar so as to close the outlet opening of the spout or collar (18) or a pierceable foil non-peelably connected to the edge of the spout or collar so as to close the outlet opening thereof.

8. A container according to claim 1, wherein the container is a bag (1,31) formed from flexible heat-sealable plastic film and provided with a carrying handle (17,47).

9. A container according to claim 8, wherein the carrying handle is attached to the circumferential wall.

10. A container according to claim 8, wherein the plastic film comprises a first film layer, the first film layer being the inner film layer of the plastic film and providing the inner antistatic surface, an antistatic additive being incorporated in the first film layer, or an antistatic coating being applied to the first film layer, the plastic film optionally comprising additional layers arranged outwardly of the first film layer.

11. A container according to claim 10, wherein the inner film layer of the plastic film is a film layer of polyethylene terephthalate (PET), the PET-film being the inner layer of the plastic film and providing the inner antistatic surface, an antistatic additive being incorporated in the PET-film, or an antistatic coating being applied to the PET film, the plastic film optionally comprising additional layers arranged outwardly of the PET-film.

12. A container according to claim 8, wherein the container is a stand-up bag and the circumferential wall (2,32) is formed by a front and a back panel (3,33;4,34) of plastic film being joined at longitudinal edges by longitudinal welding seams (5,35;6,36) and joined at upper and lower edges, and a bottom wall (7,37) is formed by an inwardly folded lower end panel (9,39) of plastic film extending between and joined to the lower edges of the front and back panels (3,33;4,34) by lower transverse welding seams (10, 40;11,41).

13. A container according to claim 12, wherein the front and back panels (3,4) are joined at the upper end by a transverse welding seam (15), the outlet member (16) being positioned and leak-proof joined between the front and back walls (3,4), the transverse welding seam (15) extending downwardly divergent, i.e. sloping, from the outlet member towards the respective longitudinal edges.

14. A container according to claim 12, wherein a top wall (49) of the bag (31) is formed by an inwardly folded upper end panel (50) of plastic film extending between and joined to the upper edges of the front and back panels (33,34) by upper transverse welding seams (52,53), the outlet member (46) being positioned and leak-proof joined between the upper end panel (50) and the upper edge of the front panel (33), the transverse welding seam (53) between the front panel (33) and the upper end panel (50) extending downwardly diverging, i.e. sloping, from the outlet member towards the respective longitudinal edges.

15. A method of dispensing polypeptide stored in a container according to claim 1, comprising the steps of:

a) leak-proof connecting the outlet member and a mating coupling member, the coupling member being a part of a receiving vessel to which the polypeptide is to be dispensed or a part of a tube connected to the vessel to which the polypeptide is to dispensed, b) placing the container so that the outlet opening of the outlet member of the container faces downwardly, and thereby allowing the polypeptide to flow by gravity from the container to the receiving vessel.

* * * * *